US007485197B2

(12) United States Patent
Tanida

(10) Patent No.: US 7,485,197 B2
(45) Date of Patent: Feb. 3, 2009

(54) METHOD FOR MANUFACTURING MARTENSITIC STAINLESS STEEL TUBE

(75) Inventor: Mutsumi Tanida, Wakayama (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 356 days.

(21) Appl. No.: 11/393,792

(22) Filed: Mar. 31, 2006

(65) Prior Publication Data

US 2006/0169375 A1 Aug. 3, 2006

Related U.S. Application Data

(63) Continuation of application No. PCT/JP2004/014853, filed on Oct. 7, 2004.

(30) Foreign Application Priority Data

Oct. 10, 2003 (JP) ..... 2003-352943

(51) Int. Cl.

| | |
|---|---|
| ***C22C 38/18*** | (2006.01) |
| ***C21D 9/14*** | (2006.01) |
| ***C21D 9/00*** | (2006.01) |
| ***C21D 8/10*** | (2006.01) |

(52) U.S. Cl. ..... 148/325; 148/909; 148/591; 148/592; 148/593; 148/606; 148/607; 148/654; 148/663; 148/664

(58) Field of Classification Search ..... 148/325.909, 148/591, 592, 593, 606, 608, 654, 663, 664
See application file for complete search history.

(56) References Cited

U.S. PATENT DOCUMENTS 6,210,806 B1 * 4/2001 Hidaka et al. ..... 428/469
6,332,934 B2 * 12/2001 Tanida et al. ..... 148/325
6,890,665 B1 * 5/2005 Tanida ..... 428/469

FOREIGN PATENT DOCUMENTS

| | | | |
|---|---|---|---|
| EP | 0 937 782 | | 8/1999 |
| JP | 57-124514 | * | 8/1982 |
| JP | 40-3082710 | * | 4/1991 |
| JP | 05-269507 | | 10/1993 |
| JP | 06-015343 | | 1/1994 |
| JP | 40-6128771 | * | 5/1994 |

(Continued)

OTHER PUBLICATIONS

Computer-generated English translation of Japanese patent 2003-226941, Tanida et al., Aug. 15, 2003.*

*Primary Examiner*—Deborah Yee
(74) *Attorney, Agent, or Firm*—Clark & Brody

(57) ABSTRACT

In a martensitic stainless steel tube according to the present invention, the content is determined by each of elements C, Si, Mn and Cr, and the bubble content ratio is further prescribed in accordance with the scale thickness on the outer surface of the steel tube, so that defects can be detected with high precision in the non-destructive inspection, such as ultrasonic test or the like. This allows the non-destructive inspection to be carried out with high efficiency. Moreover, there is another advantage that the weather resistance can be enhanced. The steel tube according to the present invention and the manufacturing method thereof can be suitably used in all of the technical fields in which a martensitic stainless steel tube having equal chemical composition is treated.

13 Claims, 5 Drawing Sheets

FOREIGN PATENT DOCUMENTS

| | | | |
|---|---|---|---|
| JP | 40-6170432 | * | 6/1994 |
| JP | 10-060538 | | 3/1998 |
| JP | 10-128412 | | 5/1998 |
| JP | 10-298657 | | 11/1998 |
| JP | 2996245 | | 10/1999 |
| JP | 2001-096304 | | 4/2001 |
| JP | 2001-303207 | | 10/2001 |

* cited by examiner

METHOD FOR MANUFACTURING MARTENSITIC STAINLESS STEEL TUBE

CROSS-REFERENCE TO RELATED APPLICATIONS

This application is a continuation of International Patent Application No. PCT/JP2004/014853, filed Oct. 7, 2004. This PCT application was not published in English under PCT Article 21(2).

FIELD OF THE INVENTION

The present invention relates to a martensitic stainless steel tube, which is capable of providing a reduced bubble/void content ratio in scales formed on a surface, along with high precision for a defect detection in a non-destructive inspection. The present invention also relates to a method for manufacturing such a martensitic stainless steel tube.

BACKGROUND ART

In manufacturing martensitic stainless steel tubes, the quality control is generally carried out so as to suppress or eliminate harmful defects, together with an inspection for assuring the quality, using a non-destructive inspection apparatus, such as an ultrasonic flaw detecting apparatus or the like. However, scales on the surface of the steel tube generates noise, and therefore, the ratio of the signal intensity representing the defects to the noise intensity (hereinafter referred to as "S/N ratio") is deteriorated (decreased), thereby increasing the re-inspection work.

In particular, in the case when an air quenching (air-cooling quenching) is applied to suppress hardening cracks in manufacturing martensitic stainless steel tubes, thick and loose scales (i.e., scales containing a number of bubbles and voids) are formed, so that a reduced magnitude of the S/N ratio is obtained, compared with ordinary carbon steel tubes. In addition, a recent increase in the flaw detection level is more and more strongly required to detect flaws each having shallow depth, since an oil well is designed or so on the basis of the fracture toughness. Therefore, in the field of producing steel tubes for an oil well, it is of new and central importance that the precision of detecting defects in the non-destructive inspection (NDI) is enhanced (i.e., the S/N ratio is improved).

Traditionally, it has been pointed out that the noise signal in the non-destructive inspection results from the scales on the surface of a steel tube. In fact, there are many steps of heating in the process of producing the steel tube, thereby making it impossible to significantly reduce the amount of scales in an actual operation. Although it is possible to suppress the generation of scales, using an atmosphere controlled furnace, such an installation requires an extremely large installation cost.

A number of researches and developments have been made on the scale from the viewpoint of the structure thereof as well as of preventing the generation of flaws resulting from the scale. A method of manufacturing a martensitic stainless seamless steel tube has been disclosed, for instance, in Japanese Patent Application Publication No. 2001-96304, wherein the generation of flaws on the outside surface can be significantly reduced by boring a billet under conditions that the thickness and void rate of a scale inside layer (inner scale) generated on the billet are maintained within predetermined ranges.

Moreover, in Japanese Patent Application Publication No. 5-269507, a method of manufacturing a seamless steel tube has been disclosed, wherein a semi-finished product of stainless steel, i.e., a billet containing Cr at 12 wt % or more is rolled after heating in a heating furnace, and further rolled after heating in a re-heating furnace, and the scale thickness on the rolled material is maintained 10-100 μm on the entrance side of each rolling stand, so that the seizure flaws and streak-shaped flaws can be suppressed.

In Japanese Patent Application Publication No. 6-15343, a descaling method has been disclosed, in which high-pressure water is sprayed onto the outer surface of a rolling blank material, and scales are removed with a wire brush in order to reduce the number of pit flaws which are generated from the intrusion of scales into the surface of the rolling blank material.

Moreover, in Japanese Patent Application Publication No. 10-60538, a method of manufacturing 13 Cr stainless seamless steel tubes has been disclosed, wherein the steel tube has an oxidation layer having a high corrosion resistance and a decreased surface roughness, in which case, outer scale layers are removed by high pressure water, after forming outer and inner scale layers having a total thickness of 100 μm or more. In addition, a method of manufacturing the 13 Cr stainless seamless steel tube has been disclosed in Japanese Patent Application Publication No. 10-128412, wherein the steel tube is coated by as-is surfaces formed in hot-rolling, in which case, the tube is rolled after removing an outer scale layer with a descaler and to maintain an inner scale at a thickness of 0.1-50 μm, so that an excellent surface properties and corrosion resistance can be obtained.

However, it is found that there are few technologies in which the thickness of scale and/or the bubble/void content ratio is specified in order to enhance the precision in the defect detection by greatly reducing the intensity of the noise detected in the non-destructive inspection, especially in the ultrasonic test (UST).

SUMMARY OF THE INVENTION

The present invention is intended to solve the above problems in the prior art. Accordingly, it is an object of the present invention to provide a martensitic stainless steel tube and a method for manufacturing such a stainless steel tube, wherein the S/N ratio can be improved in the non-destructive inspection, such as the ultrasonic test, thereby enabling the precision to be enhanced in the defect detection.

The present inventors carried out several investigations to solve the above problems, and it was found that the deterioration of the S/N ratio in the ultrasonic test resulted from the scale thickness on the tube surface and from the bubbles and/or voids (hereinafter referred to as "bubbles" inclusive of the voids, and the existence rate thereof is denoted by "bubble content ratio") in the scales, and that the S/N ratio is significantly deteriorated, when the bubble content ratio is greater than or equal to a specific value which is determined from the scale thickness on the surface, in particular, the outer surface of the tube.

Furthermore, the present inventors carried out several investigations as for the method for manufacturing a martensitic stainless steel tube having an improved S/N ratio, and it was found that such a steel tube can be obtained by cooling it in the sequence of "water-cooling", "air-cooling" and "water-cooling", each of which is carried out within a specified temperature range from the high temperature under quenching conditions, in particular, under cooling conditions after quenching, in the heat treatment after the steel tube making.

FIG. 9A is a sectional micrograph of a scale on the surface of a martensitic stainless steel, which was obtained by the manufacturing method in the prior art, and FIG. 9B is a sectional micrograph of a scale on the surface of a martensitic stainless steel, which was obtained by the manufacturing method according to the invention. From the micrographs in FIGS. 9A and 9B, it is found that a number of bubbles exist in the scales obtained by the manufacturing method in the prior art, whereas such bubbles are significantly reduced in the scale obtained by the manufacturing method according to the invention.

On the basis of the above experimental knowledge, the present invention provides the following martensitic stainless steel tube described in (1) and (2), and a method of manufacturing such a stainless steel tube, which method is described in (3), and a system for manufacturing such a stainless steel tube, which system is described in (4).

(1) A martensitic stainless steel tube including C: 0.15-0.22%, Si: 0.1-1.0%, Mn: 0.30-1.00% and Cr: 12.00-16.00% in mass %, wherein the scale thickness on the outer surface of the steel tube is 150 μm or less, and wherein the bubble content ratio satisfies the following equation (1):

$$\text{bubble content ratop } (\%) \leqq -6.69 \times \ln(ds) + 40.83 \quad (1)$$

where ds: scale thickness (μm), and ln(x): natural logarithm of x.

It is possible that the martensitic stainless steel tube described in (1) further includes at least one of Al: 0.1% or less, Ni: 1.0% or less and Cu: 0.25% or less in mass %.

(2) A martensitic stainless steel tube including C: 0.15-0.22%, Si: 0.1-1.0%, Mn: 0.30-1.00% and Cr: 12.00-16.00% in mass %, wherein the scale thickness on the outer surface of the steel tube is 5-100 μm, and wherein the bubble content ratio satisfies the following equation (2):

$$\text{bubble content ratio } (\%) \leqq -5.20 \times \ln(ds) + 30.20 \quad (2)$$

where ds: scale thickness (μm), and ln(x): natural logarithm of x.

It is possible that the martensitic stainless steel tube described in (2) further includes at least one of Al: 0.1% or less, Ni: 1.0% or less and Cu: 0.25% or less in mass %.

(3) A method for manufacturing a martensitic stainless steel tube including C: 0.15-0.22%, Si: 0.1-1.0%, Mn: 0.30-1.00% and Cr: 12.00-16.00% in mass % or a martensitic stainless steel tube further including one group or more of Al: 0.1% or less, Ni: 1.0% or less and Cu: 0.25% or less in mass % in addition to said components, said method comprising the following steps of: heating an in-process steel tube for duration between 5 min. or more and 30 min. or less at a temperature of "$A_{c3}$ point+20° C." to 980° C. or lower in an atmosphere containing amount of oxygen 2.5 vol. % or less and amount of water vapor 15.0 vol. % or less, quenching the steel tube at a cooling rate of 1-40° C./sec. from 980° C. to the A point, at a cooling rate of less than 1° C./sec. from the A point to the B point and at a cooling rate of 5-40° C./sec. from the B point to the ambient temperature, where the A point is 680-350° C. and the B point is 300-150° C., and spraying a high-pressure water having a pressure of 490 N/mm$^2$ or higher onto the outer surface of the steel tube during at least part of the cooling duration from 900° C. to the A point of said quenching.

In the method for manufacturing a martensitic stainless steel tube, which method is described in (3), not only the S/N ratio can be improved, but also both the rust proof and the weather resistance are efficiently enhanced, when a quenching furnace, which has an atmosphere including amount of oxygen 1.5 vol. % or less and amount of water vapor 3-10.0 vol. % is used.

Moreover, the toughness is enhanced if the tempering process is carried out at a temperature of 630° C. or more after the quenching process.

Furthermore, the S/N ratio is also further improved if the descaling process by means of brush or shot is carried out at a temperature range of 700-250° C. in the cooling step of the tempering process.

Furthermore, the S/N ratio is further improved if a high-pressure water having a pressure of 30 N/mm$^2$ or higher is sprayed onto the outer surface of the steel tube, after tempering the martensitic stainless steel tube described in above (1) or (2).

(4) A system for manufacturing a martensitic stainless steel tube including C: 0.15-0.22%, Si: 0.1-1.0%, Mn: 0.30-1.00% and Cr: 12.00-16.00% in mass % or a martensitic stainless steel tube further including one group or more of Al: 0.1% or less, Ni: 1.0% or less and Cu: 0.25% or less in mass % in addition to said components, said system comprising: a quenching furnace; a high-pressure water descaler disposed on the exit side of said quenching furnace; an air-cooling apparatus disposed on the exit side of said high-pressure water descaler; a water-cooling apparatus disposed on the exit side of said air-cooling apparatus; and a tempering furnace.

In the manufacturing system described in (4), it is preferable that one or more thermometers are disposed in at least one position among those such as; on the entrance side and exit side of said air-cooling apparatus; on the entrance side and exit side of the water-cooling apparatus; and on the entrance side of said tempering furnace, because the temperature of the steel tube can be sensed in the cooling process.

Furthermore, it is preferable, if a brush or shot apparatus is disposed on the exit side of said tempering furnace, or if a high-pressure water spray apparatus for spraying a high-pressure water onto the outer surface of said steel tube is disposed on the exit side of said tempering furnace, or a brush or shot apparatus is disposed on the exit side of said tempering furnace and a high-pressure water spray apparatus is further disposed on the downstream side thereof.

The term "bubble content ratio" used herein means the ratio of the surface area of the bubbles to the sectional area (the sectional area in the direction vertical to the tube axis) of the scales formed on the surface of the steel tube. As described above, the "bubbles" include voids.

In accordance with the invention, the martensitic stainless steel tube described in above (1) and (2) provides a reduced bubble content ratio in the scales formed on the surface of the steel tube, and further improves the S/N ratio in the non-destructive inspection, such as the ultrasonic test or the like, thereby ensuring high precision in the defect detection. Such a steel tube can be produced by the manufacturing method described in above (3) and by the manufacturing system described in above (4).

BEST MODE FOR CARRYING OUT THE INVENTION

Figure 1:
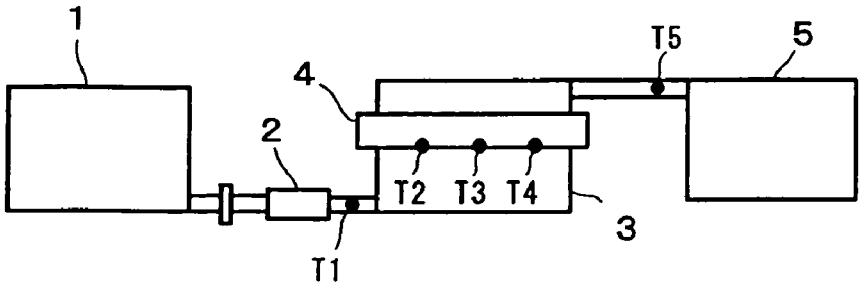
FIG. 1 is a view showing a schematic structural example of a system for carrying out the method of manufacturing a martensitic stainless steel tube according to the present invention.

In the following, martensitic stainless steel tubes according to the present invention (each of which is described in afore-mentioned (1) or (2)), a method for manufacturing the same (which method is described in afore-mentioned (3)) and a system for manufacturing the same (which system is described in afore-mentioned (4)) will be described in detailed manner. In this case, the symbol "%" for each alloy element implies "mass %".

As described above in (1), the martensitic stainless steel tube is a "martensitic stainless steel tube including C: 0.15-0.22%, Si: 0.1-1.0%, Mn: 0.30-1.00%, and Cr: 12.00-16.00%, wherein the scale thicknesss on the outer surface of the tube is 150 μm or less and wherein the bubble content ratio satisfies the following equation (1):

$$\text{bubble content ratio } (\%) \leqq -6.69 \times \ln(ds) + 40.83 \quad (1)$$

where ds means scale thickness (μm) and ln(x) means natural logarithm of x".

Firstly, the reason why the chemical composition of the martensitic stainless steel tube is determined as above will be described:

C: 0.15-0.22%

Carbon C is an element necessary for enhancing the mechanical strength of steel. In this case, a C content of 0.15% or more is required to obtain a strength of 552 MPa or higher. Since, however, an excessively increased C content causes both the corrosion resistance and the toughness to be reduced, the C content should be 0.22% or less. Since C is an element for generating austenite, an excessively reduced C content assists to generate defects on the inner surface due to δ ferrite after making the steel tube. Accordingly, the C content should be 0.15-0.22%, more preferably 0.18-0.22%.

Si: 0.1-1.0%

Silicon Si is used as a deoxidizer for steel. However, a Si content of less than 0.1% provides no significant effect of deoxidization, and the Si content of more than 1.0% causes the toughness to be deteriorated. Accordingly, the Si content should be 0.1-1.0%. However, the Si content should be preferably 0.75% or less, or most preferably 0.20-0.35%, in order to obtain an appropriate magnitude of toughness.

Mn: 0.30-1.00%

Manganese Mn is an element effective for enhancing the mechanical strength of steel, and also has a deoxidizing effect similar to Si. Moreover, Mn allows S in steel to be immobilized in the form of MnS, thereby improving the hot workability. A Mn content of less than 0.30% provides a relatively small effect on the properties, and the toughness is deteriorated at a Mn content of more than 1.00%. Accordingly, the Mn content should be 0.30-1.00%. However, the Mn content should be preferably 0.7% or less in order to obtain an appropriate magnitude of toughness.

Cr: 12.00-16.00%

Chromium Cr is a basic element for enhancing the corrosion resistance for steel. In particular, a Cr content of 12.00% or more allows the corrosion resistance to be improved as for pitting corrosion and crevice corrosion, along with a significant enhancement of the corrosion resistance in the $CO_2$ environment. On the one hand, Cr is an element for generating ferrite, and δ ferrite is often generated in high-temperature process at a Cr content of 16.00% more than and therefore the hot workability is reduced. On the other hand, an excessively large Cr content causes the manufacturing cost to be increased. Accordingly, the Cr content should be 12.00-16.00%, or more preferably 12.20-13.50%.

In addition to the above-described components, one group or more of Al: 0.1% or less, Ni: 1.0% or less and Cu: 0.25% or less can be included in the martensitic stainless steel tube according to the present invention. The reason for specifying the content of these elements as above is as follows:

Al: 0.1% or less

Aluminum Al is effective as a deoxidizer for steel. However, an excessively large Al content deteriorates the cleanliness in steel, and generates a clogging for an immersion nozzle in the case of continuous casting. Accordingly, the Al content should be 0.1% or less. Although there is no special limitation as regards the lower limit of the Al content, it is preferable that the Al is included at a content of 0.001% or more to obtain the effect of deoxidizer.

Ni: 1.0% or less

Nickel Ni is an element for stabilizing austenite and improves the hot workability for steel. However, an excessively large Ni content causes the sulfide stress corrosion resistance to be reduced. Accordingly, the Ni content should be 1.0% or less. Although there is no special limitation as regards the lower limit of the Ni content, it is preferable that Ni is included at a content of 0.05% or more to obtain the above-described effect.

Cu: 0.25% or less

Copper Cu is an element for enhancing the corrosion resistance for steel as well as an element for stabilizing austenite, thereby enabling the hot workability to be improved for steel. However, the low melting point of Cu causes the hot workability to be deteriorated at an excessively large Cu content. Accordingly, the Cu content should be 0.25% or less. Although there is no special limitation as regards the lower limit of the Cu content, it is preferable that Cu is included at a content of 0.005% or more to obtain the above-described effect.

The residue includes Fe and impurities, such as P, S, N and others. In this case, it is possible that Ti and V are included therein at a concentration of 0.2% or less respectively.

The scale thickness (the thickness of both the outer layer and inner layer) on the outside surface of the martensitic stainless steel tube including the components as described above is 150 μm or less. This is due to the fact that, in case of the scale thickness more than 150 μm even if the bubble content ratio satisfies the equation (1), ultrasonic waves do not propagate into the steel tube material but are reflected therefrom, thereby generating the noise in the non-destructive inspection. Although there is no special limitation as regards the lower limit of the scale thickness, it is difficult to decrease the scale thickness, for instance, within less than 5 μm in a controlled atmosphere furnace used for producing the steel tube, as described below, so that the lower limit is automatically determined.

Moreover, the bubble content ratio is required to satisfy the equation (1). This is due to the fact that, when the bubble content ratio is more than a specific value which is determined from the right hand side of equation (1) dependent on the scale thickness, the S/N ratio decreases, thereby causing the precision in the defect detection to be lowered in the non-destructive inspection. The equation (1) is determined under the condition of S/N≧3 from various experimental results, as described below in the embodiments. In other words, the right hand side of equation (1) provides the upper limit, below which the bubble content ratio has to be situated, in order to satisfy the relation of S/N≧3.

Furthermore, the martensitic stainless steel tube described in (2) is a "martensitic stainless steel tube, which has a C content 0.15-0.22%, a Si content of 0.1-1.0%, a Mn content of 0.30-1.00%, and a Cr content of 12.00-16.00%, wherein the scale thicknesss on the outer surface of the tube is 5-100 μm and wherein the bubble content ratio satisfies the following equation (2):

$$\text{bubble content ratio } (\%) \leqq -5.20 \times \ln(ds) + 30.20 \quad (2)$$

where ds means scale thickness (μm) and ln(x) means natural logarithm of x".

In addition to the above-described components, one group or more of Al: 0.1% or less, Ni: 1.0% or less and Cu: 0.25% or less can be included in the martensitic stainless steel tube. Moreover, as for the residual, the same relation as that in the martensitic stainless steel tube described in above (1) is applicable. The chemical composition (elements and content thereof) and the reason for numerical specification thereof are the same as in the martensitic stainless steel tube described in above (1).

The scale thickness (the thickness of the outer layer and inner layer) on the outside surface of the martensitic stainless steel tube should be 5-100 μm. This is due to the fact that, when the scale thickness is either less than 5 μm or more than 100 μm, the relation of S/N≧3 is not held even if the bubble content ratio satisfies the equation (2), thereby reducing the precision in the defect detection.

Furthermore, the bubble content ratio is determined so as to satisfy the equation (2). This is due to the fact that, when the bubble content ratio is greater than a specific value determined from the right side of equation (2) dependent on the scale thickness, the S/N ratio becomes smaller, thereby causing the precision in the defect detection to be lowered in the non-destructive inspection. Similarly to the equation (1), the equation (2) is determined from various experimental results under the condition of the relation S/N≧3.

In the method for manufacturing a martensitic stainless steel tube, which method is described in above (3), "an in-process steel tube is heated for duration between 5 min. or more and 30 min. or less in an atmosphere including oxygen at a concentration of 2.5 vol. % or less and water vapor in a concentration of 15 vol. % or less at a temperature between '$A_{c3}$ point+20° C.' or higher and 980° C. or lower, and thereafter it is quenched at a cooling rate of 1-40° C./sec. from 980° C. to the A point, at a rate of less than 1° C./sec. from the A point to the B point and at a cooling rate of 5-40° C./sec. from the B point to the ambient temperature, in which case, high-pressure water having a pressure of 490 N/m$^2$ or higher is sprayed onto the outer surface of the tube for at least part of the cooling duration from 900° C. to the A point in the quenching process, where the A point is 680-350° C. and the B point is 300-150° C.", so that the martensitic stainless steel described in above (1) can be produced.

In the tube making process, the conventional process used for manufacturing Cr type stainless steel tubes can be employed till the steel tube is produced in the form of a predetermined shape.

After making the steel tube, it is cooled down to the ambient temperature by air-cooling, and then the quenching process is applied. In this case, the atmosphere in the quenching furnace contains oxygen amount of 2.5 vol. % or less and amount of water vapor 15.0 vol. % or less. The atmosphere and cooling conditions in the quenching effect the formation of bubbles in the scales, and it is necessary to employ the above-described atmosphere.

The quenching temperature of "$A_{c3}$ point+20° C." or higher ensures to produce stable austenite. However, a quenching temperature higher than 980° C. causes to coarsen the grain size and to reduce the toughness of a material as quenched and of a product produced therefrom.

The soaking time at the quenching temperature is selected between 5 min. or more and 30 min. or less. This is due to the fact that a soaking time of less than 5 min. provides an incomplete solid solution of carbides, thereby causing the magnitude of mechanical strength to be scattered, whereas a soaking time of more than 30 min. causes the grain size to be coarsened, so that the toughness is decreased and the noise intensity is increased in the non-destructive inspection, such as the ultrasonic test or the like.

The cooling rate and the temperatures after heating at the quenching temperature are exactly specified in detailed manner. This is due to the fact that the bubble content ratio in scales formed in the cooling process is set at a predetermined value or less and it is important to prevent the cracks from generating in the martensitic stainless steel having high C concentration and high Cr concentration according to the present invention. In other words, when it is assumed that the A point is 680-350° C. and the B point is 300-150° C., the steel tube is firstly cooled at a cooling rate of 1-40° C./sec. from 980° C. to the A point. In the cooling process, the water-cooling by means of a shower or the like is desirable.

Subsequently, the steel tube is cooled at a cooling rate of less than 1° C./sec. from the A point to the B point. In the cooling process, the air-cooling is desirable. Thereafter, the cooling is carried out at a cooling rate of 5-40° C./sec. from the B point to the ambient temperature. In the cooling process, the water-cooling by means of a shower or the like is desirable. The restriction of the A point into 680-350° C. is due to the fact that an A point of more than 680° C. causes to prolong the cooling (air-cooling) duration in the next stage, so that the productivity is lowered, and further such an A point reduces the effect of suppressing scale generation, whereas the A point of less than 350° C. increases the cooling rate, because it is feared that the quenching cracks may be generated. It is preferable that said A point is restricted into 600-350° C. in order to more effectively suppress scale generation.

The restriction of the B point between 300-150° C. is due to the fact that, in the case when the B point is set more than 300° C., the cooling from the B temperature to the ambient temperature is substantially the same as the cooling from the Ms point, so that the quenching cracks are generated, whereas, in the case when the temperature is set less than 150° C., the cooling (air-cooling) duration in the last stage is prolonged, thereby causing the productivity to be lowered.

Moreover, at least part of cooling duration from 900° C. to the A point is carried out in the quenching process, by spraying high-pressure water having a pressure of 490 N/mm$^2$ or higher onto the outer surface of the stainless tube. Generally, the descaling from the surfaces of a material with a high-pressure water descaler after heating at high temperature is employed. In this case, the temperature is normally 750-900° C. However, even if the scales are completely removed, the cooling rate is slower at the temperature range of 350-750° C., so that secondary scales are generated unless the cooling rate becomes 1-40° C./sec.

In order to obtain the descaling effect, a pressure of 490 N/mm$^2$ or higher is required for the high-pressure water.

The atmosphere in the quenching furnace and the cooling conditions (inclusive of the descaling by the high-pressure water at the high temperature range of 900° C. or less) are specified as above, thereby making it possible to produce the martensitic stainless steel tube described in above (1).

In the manufacturing method described in above (3), the martensitic stainless steel tube described in above (2) can be produced, using a quenching furnace which is filled with an atmosphere including oxygen at a concentration of 1.5 vol. % or less and water vapor at a concentration of 3-10.0 vol. %.

The steel tube manufactured with the above method (the martensitic stainless steel tube described in above (2)) has a scale thickness of 5-100 μm, and satisfies the equation (2) as for the bubble content ratio in the scales. In fact, the bubble content ratio becomes lower than that of the scales formed on the surfaces of the steel tube described in above (1).

The scales having each thickness of 5 μm or more are always deposited on the tube surfaces and play a role as a coating film. Hence, not only the S/N ratio is improved, but also the rust generation (in the state before oil is applied to the surface) can be suppressed in the course of the production process, along with a firm and exfoliation-proof deposition of the scales. As a result, neither the scales are peeled off due to the handling after the oil is applied, nor the effect of the oil application is lost, so that the weathering resistance is enhanced.

In the method for manufacturing a martensitic stainless steel tube, which method is described in above (3) (inclusive of the method, using a quenching furnace which is filled with an atmosphere including amount oxygen of 1.5 vol. % or less and amount of water vapor of 3-10.0 vol. %), the toughness can be enhanced, if a tempering process is carried out at a temperature range of 630° C. or higher after applying the above-described quenching process.

When the descaling process by means of brush or shot is applied at a temperature range of 700-250° C., utilizing the heat of the tempered steel tube in the cooling step of the tempering process, cracks are generated in the scales and, therefore, a medium for detecting defects is easily intruded into bubbles, hence enabling the S/N ratio to be greatly improved. It is found that the effect of improving the S/N ratio can be obtained, if the cracks extending from the outer layer into the inner layer of the scales at a depth corresponding to the 30% or more of the total thickness of the scales are generated, and if the area of the cracks (the area on the scale surface) becomes about 2% or more of the entire scale surface areas.

In the above case, the temperature is specified at 700-250° C. This is due to the fact that, when taking into account the temperature in the case of the tempering process, it is difficult to apply a temperature of higher than 700° C., and that a temperature of lower than 250° C. decreases the effect of generating the cracks.

Moreover, the S/N ratio can also be improved to more extent, if a high-pressure water having a pressure of 30 N/mm$^2$ or higher is sprayed onto the outer surface of the steel tube after cooled at a predetermined temperature in the above tempering process. This may be due to the fact that the application of water pressure assists the medium for detecting defects to easily intrude into bubbles in the scales. Under the circumstance, the water sprayed on the surface of the steel tube must not be evaporated in the NDI operation.

In this case, the upper limit of the bubble content ratio in the scales formed on the outer surface of the manufactured martensitic stainless steel tube (the upper limit below which the bubble content ratio is situated to satisfy the relation of S/N≧3) is not expressed by equation (1), but by equation (3). From the comparison with equation (1), as is clear from follows that the S/N ratio is improved even if the upper limit for the bubble content ratio is increased to some extent:

$$\text{bubble content ratio } (\%) \leqq -5.9 \times \ln(ds) + 39.60 \quad (3)$$

where ds: thickness of scales (μm), and ln(x): natural logarithm of x.

The high-pressure water having a pressure of 30 N/mm$^2$ or more can be sprayed onto the outer surface of the steel tube after the tempering process is applied and then the descaling process by means of a brush or shot is applied. In this case, the S/N ratio is more significantly improved.

The system for manufacturing a martensitic stainless steel tube, which system is described in above (4), is a system for performing the method for manufacturing a martensitic stainless steel tube, which method is described in above (3), that is, "a system for manufacturing a martensitic stainless steel tube including C: 0.15-0.22%, Si: 0.1-1.0%, Mn: 0.30-1.00% and Cr: 12.00-16.00%, and one group or more of Al: 0.1% or less, Ni: 1.0% or less and Cu: 0.25% or less in addition to the above elements, wherein said system is equipped with a quenching furnace, a high-pressure water descaler disposed on the exit side thereof, an air-cooling apparatus disposed on the exit side thereof, a water-cooling apparatus disposed on the exit side thereof, and a tempering furnace".

In the manufacturing system, it is preferable that one or more thermometers are disposed in at least one position among those such as; on the entrance side and the exit side of the air cooling apparatus; on the entrance side and the exit side of the water-cooling apparatus; and on the entrance side of the tempering furnace in order to sense the temperature of the steel tube in the cooling process.

FIG. 1 is a view showing a schematic structural example of such a system, in which case, the system is equipped with a tempering furnace. As shown in FIG. 1, the system includes a quenching furnace 1, a high-pressure water descaler 2, an air-cooling apparatus 3, a water-cooling apparatus 4 connected thereto for cooling the outer surface of the steel tube, and a tempering furnace 5. In this case, a thermometer T1 is disposed on the entrance side of the air cooling apparatus 3; thermometers T2, T3 and T4 are disposed on the entrance side of the water-cooling apparatus 4; and a thermometer T5 is disposed on the entrance side of the tempering furnace 5.

The high-pressure water descaler 2 is formed in the shape of a ring for effectively descaling the outer surface of the steel tube. A shower-type water-cooling apparatus (not shown) can be disposed on the downstream side of the high-pressure water descaler 2. The thermometer T1 is disposed to sense the temperature of the steel tube on the exit side of the high-pressure descaler 2 (before the steel tube is charged into the air-cooling apparatus 3).

The air-cooling apparatus 3 is designed, for example, such that the entire outer surface of the tube is cooled from the lower side with a fan or a blower, and that the inner surfaces are cooled at the tube ends with an air nozzle. The water-cooling apparatus 4 is, for example, a shower-type cooling apparatus for cooling the outer surface of the tube. In this case, the thermometers T2, T3 and T4 are disposed to sense the predetermined temperatures of the steel tube arranged on the entrance side of the water-cooling apparatus 4.

A straightner (not shown) can be disposed on the exit side of the tempering furnace 5. In this case, the thermometer T5 is mounted onto the entrance side of the tempering furnace 5 in order to sense the temperature of the steel tube.

The steel tube soaked under the above-described conditions by the quenching furnace 1 is descaled by the high-pressure water descaler 2, and further cooled at the above-described predetermined temperatures by the air-cooling apparatus 3 and water-cooling apparatus 4 in accordance with the temperatures measured by the respective thermometers. Thereafter, the steel tube is transferred to the next process via the tempering furnace 5.

In the above manufacturing system, either a brush or shot apparatus, or a high-pressure water spray apparatus for spraying high-pressure water onto the outer surface of the steel tube can be disposed on the exit side of the tempering furnace 5. In another embodiment, the brush or shot apparatus and the high-pressure water spray apparatus can be disposed on the downstream side of the tempering furnace 5.

Figure 2:
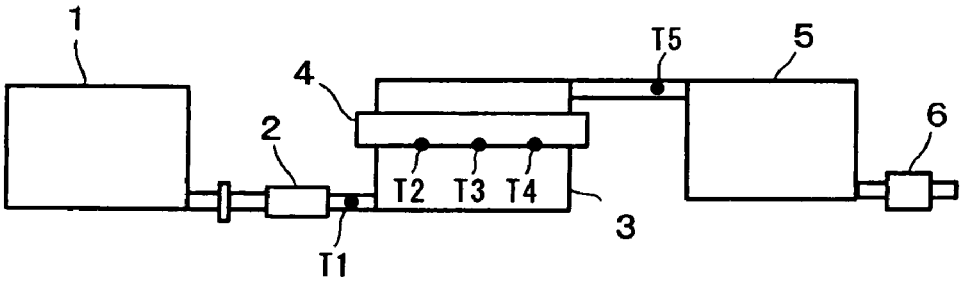
FIG. 2 is a view showing a schematic structural example of another system for carrying out the method of manufacturing a martensitic stainless steel tube according to the present invention, wherein a brush or shot apparatus is disposed on the exit side of a tempering furnace.

FIG. 2 is a view showing a schematic structural example of another manufacturing system, in which case, a brush or shot apparatus 6 is disposed on the exit side of the tempering furnace 5. A straightner can also be disposed so as to simultaneously correct the straightness of the steel tube with respect to the front stage or rear stage of the brush or shot apparatus 6, and to the brush or shot apparatus on the exit side of the tempering furnace 5.

Figure 3:
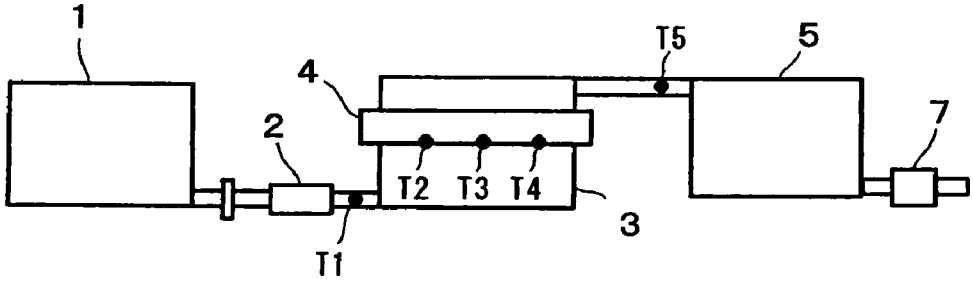
FIG. 3 is a view showing a schematic structural example of another system for carrying out the method of manufacturing a martensitic stainless steel tube according to the present invention, wherein a high-pressure water spray apparatus is disposed on the exit side of a tempering furnace.
Figure 4:
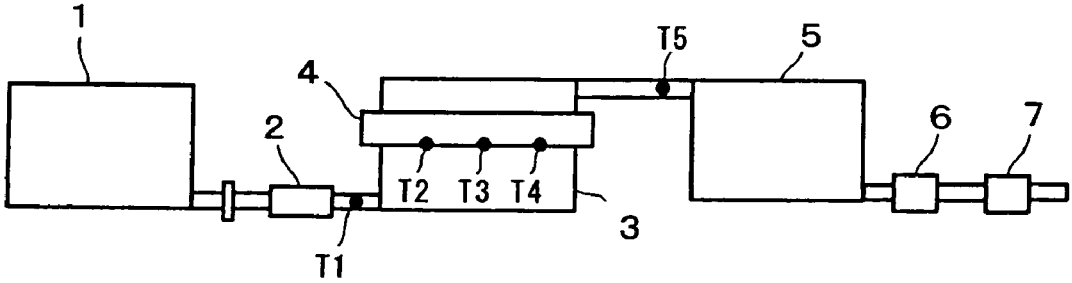
FIG. 4 is a view showing a schematic structural example of another system for carrying out the method of manufacturing a martensitic stainless steel tube according to the present invention, wherein a brush or shot apparatus and a high-pressure water spray apparatus are disposed on the exit side of a tempering furnace.

FIG. 3 is a view showing a schematic structural example of another manufacturing system, in which case, a high-pressure water spray apparatus 7 is disposed on the exit side of the tempering furnace 5. Furthermore, FIG. 4 is a schematic sectional view of another manufacturing system, in which case, both a brush or shot apparatus 6 and a high-pressure water spray apparatus 7 are disposed on the exit side of the tempering furnace 5. In these cases, a straightner can also be disposed on the entrance side of the high-pressure water spray apparatus 7.

By utilizing one of the above manufacturing systems, the method for manufacturing a martensitic stainless steel tube, which method is described in above (3), can be carried out.

In the following, the ultrasonic test which is useful for detecting harmful defects, such as flaws, in the above-described martensitic stainless steel tubes or the other steel tubes will be described.

In the ultrasonic test used therefore, defects are normally inspected, using a local immersion type apparatus in which a fluid, such as water, is used as a medium for detecting defects. In this case, the precision in the defect detection can be enhanced with the aid of the S/N ratio improved by intruding beforehand the medium for detecting defects into the bubbles in the scales formed on the surface of the steel tube. It is effective to employ the following measures, for instance, the spraying of high-pressure water onto the outer surface of the steel tube, the descaling process with brush or shots, and others prior to the execution of the ultrasonic test. Furthermore, it is effective to use a liquid capable of decreasing the surface tension as for the medium for detecting defects.

In such an ultrasonic test, there are the following two ultrasonic test methods (a) and (b):

(a) An ultrasonic test method in which a high-pressure water having a pressure of 30 N/mm$^2$ or more is sprayed onto the outer surface of a steel tube on which the scales are deposited.

In this ultrasonic test method, the descaling process by means of brush or shot at a temperature range of 700-250° C. is useful for improving the S/N ratio. If this process is applied in the cooling stage after the heat treatment (for example, tempering treatment) of the steel tube, this method is effective because the sensible heat can be used.

(b) An ultrasonic test method for either a martensitic stainless steel tube including C: 0.15-0.22%, Si: 0.1-1.0%, Mn: 0.30-1.0%, Cr: 12.00 -16.00%. or a martensitic stainless steel tube including one group or more of Al: 0.1% or less, Ni: 1.0% or less, and Cu: 0.25% or less in addition to the above components wherein a quenching process or a further tempering process is carried out after making the steel tube, and a high-pressure water having a pressure of 30 N/mm$^2$ or higher is sprayed on the outer surface of the steel tube just before carrying out the ultrasonic test after cooled down to the ambient temperature.

In this ultrasonic test method, the descaling process by means of brush or shots at a temperature range of 700-250° C. in the cooling stage after tempering also provides an efficient improvement of the S/N ratio. It is further effective, when the high-pressure water having a pressure of 30 N/mm$^2$ or higher is sprayed onto the outer surface of the steel tube just before carrying out the ultrasonic test after the descaling process by means of brush or shot.

The term "just before carrying out the ultrasonic test" means that the ultrasonic test is carried out in the time sequence before the water evaporation after the high-pressure water is sprayed.

The spraying of the high-pressure water onto the outer surface of the steel pipe causes the S/N ratio to be improved. This is due to the fact that the water pressure assists the medium for detecting defects to easily intrude into the bubbles in the scales. In this case, the high-pressure water having a pressure of 30 N/mm$^2$ or more is used, since it provides a more increased effect than the high-pressure water having a pressure of lower than 30 N/mm$^2$.

Moreover, the descaling process by the brush or shot is carried out at the temperature range of 700-250° C. This is due to the fact that the process causes cracks to be generated in the scales, and therefore the medium for detecting defects can easily be intruded into the bubbles, thereby making it possible to significantly improve the S/N ratio. It is found that the effect of improving the S/N ratio can be obtained, if the cracks extending from the outer layer into the inner layer of the scales at a depth corresponding to the 30% or more of the total thickness of the scales are generated, and if the area of the cracks (the area on the scale surface) becomes about 2% or more of the entire scale surface areas.

The selection of the above temperature range of 700-250° C. is due to the fact that it is difficult to set at such a temperature higher than 700° C., when taking into account the temperature used in the tempering process, and a temperature of lower than 250° C. reduces the effect of generating the cracks.

EXAMPLES

Using steel including chemical composition shown in Table 1, seamless steel tubes, each having an outside diameter of 139.7 mm and a thickness of 9.17 mm, were produced by the hot-rolling, subsequently cooled in air down to the ambient temperature. Then, those in-process tubes were soaked for 15 min. at 970° C. in quenching furnace, followed by water quenching down to 560° C. (cooling rate: 22-34° C./sec.). Herein, a high-pressure water descaler is used to cool above tubes from 910° C. down to 780° C. In succession, above tubes were air cooled down to 190° C. (cooling rate: 0.4-0.6° C./sec.). Whilst, an oxygen concentration and a water vapor concentration in atmosphere controlled furnace for quenching were varied along with the pressure of high-pressure water for quenching so as to prepare various samples having a different scale thickness and a different bubble content ratio (the shape: diameter; 139.7 mm, thickness; 9.17 mm, and length; 10 m). The S/N ratio of these samples was evaluated in the ultrasonic test.

TABLE 1

| Chemical Composition of Tested Steel Tube (Unit: Mass %) | | | | | | | | | | | |
|---|---|---|---|---|---|---|---|---|---|---|---|
| C | Si | Mn | P | S | Cr | Ni | Al | N | Cu | Ti | V |
| 0.19 | 0.25 | 0.65 | 0.015 | 0.002 | 12.8 | 0.08 | 0.032 | 0.032 | 0.01 | 0.01 | 0.07 |

The measurement of the bubble content ratio was carried out as follows; four micrographs (magnification: ×500) of outer surface region for each cross section at both tube ends as well as its mid length were taken respectively; those micrographs were further enlarged by two; grid representation with 1 mm spacing was made in scale portion; it was sentenced whether the bubble or the scale itself stayed at each grid point, and the number of grid points for bubble presence or otherwise was deemed as the number of bubbles or scales; and then bubble content ratio was calculated by equation below:

bubble content ratio=[number of bubbles/(number of bubbles+number of scales)]×100.

The ultrasonic test was carried out by covering 100% of the outer surface of each sample with an L-direction angle beam inspection in a local water immersion type ultrasonic test apparatus. In this case, the sensitivity of the ultrasonic test apparatus was determined, referring to artificial defects located at a depth corresponding to 3% of the thickness of the seamless steel tube from the outer surface thereof (electric discharge method (EDM) notch: depth; 0.275 mm, width; 1 mm, and length; 50.8 mm).

In the evaluation of the S/N ratio, the emission of an ultrasonic wave onto the sample was ten-times repeated, and the defect signal intensity and noise intensity were measured in each emission. The S/N ratio was determined by averaging the defect signal intensities thus determined and the noise intensities thus determined. In the evaluation, it was judged that the precision of defect detection was good if S/N≧3 (represented by mark O in Tables 3 and 4 which will later be described), whereas it was bad if S/N<3 (represented by mark x).

As for some of the samples, the weather resistance test was carried out, using steel tubes each having a length of 500 mm. In this test, a sample was prepared by cutting the seamless steel tube in the direction vertical to the axis, and oil was applied to the outer surface of the sample. After completely drying the oil, an impact load was applied to the oil and scales of the sample, dropping a 150 kg weight having a tip curvature radius R of 90 mm from a height of 300 mm. Thereafter, an outdoor exposure test was made for three months. In the test, it was judged that the sample was good if any rust was not recognized (represented by mark O in Table 4 which will later be described), whereas it was judged that the sample was bad if the rust was recognized (represented by mark x).

Using part of the initially prepared samples (the same as the samples D3, D4 and D5 in Tables 3 and 4), the effect of the spray pressure of high-pressure water with respect to the S/N ratio was studied, spraying the high-pressure water just before the ultrasonic test.

The results are listed in Table 2. Moreover, FIG. 5 graphically illustrates the results in Table 2.

TABLE 2

| Sample No. | Scale Thickness (μm) | Bubble Content Ratio (%) | Spray Pressure of High-Pressure Water ($N/mm^2$) | | | | | | |
|---|---|---|---|---|---|---|---|---|---|
| | | | No Spray of High-Pressure Water | 5 | 10 | 20 | 30 | 50 | 100 |
| D3 | 115 | 10 | 2.9 | 2.7 | 2.8 | 2.8 | 3.5 | 3.6 | 3.9 |
| D4 | 130 | 9 | 2.3 | 2.4 | 2.5 | 2.9 | 3.2 | 3.4 | 3.5 |
| D5 | 143 | 12 | 2.4 | 2.6 | 2.4 | 2.7 | 2.9 | 2.8 | 2.9 |

Figure 5:
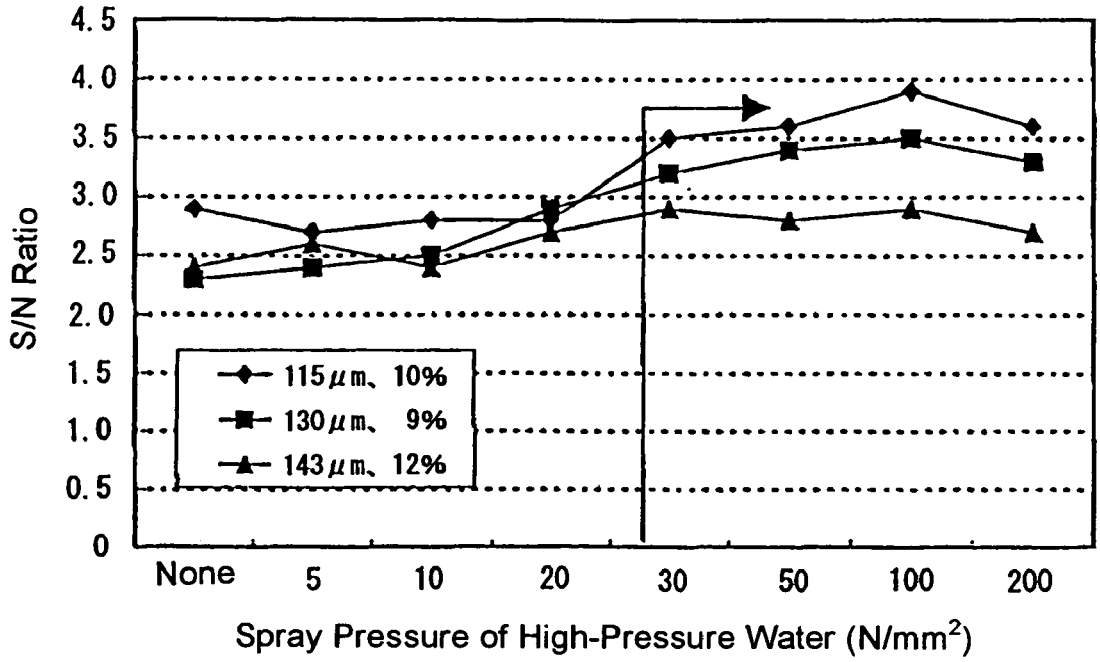
FIG. 5 is a view showing the influence of the spray pressure of high-pressure water on the S/N ratio in the experimental results.

As clearly seen in the results, the S/N ratio increases with an increase in the spray pressure of the high-pressure water, and the relation of S/N≧3 is generally held at a spray pressure of 30 $N/mm^2$ or higher (indicated by an arrow in FIG. 5).

In the following, the S/N ratio was determined, carrying out the ultrasonic test, as for both the samples to which the tempering process was applied, after the quenching process, and the samples which were tempered after the quenching process, and then onto which high-pressure water was further sprayed after cooled down to the ambient temperature. Incidentally, an oxygen concentration as well as a water vapor concentration during heating in quench furnace, and a pressure of high-pressure water in quenching are listed in Table 3. The results obtained are listed in Table 4. In Table 4, the items "Conformance to Eq. (1)" and "Conformance to Eq. (3)" mean whether equation (1) is satisfied and whether equation (3) is satisfied, respectively. In comparison of "the calculated value of the right hand side of equation (1) as for the bubble content ratio" and "the calculated value of the right hand side of equation (3) as for the bubble content ratio" with the corresponding "bubble content ratio", the case in which either equation (1) or equation (3) is satisfied is represented by mark O, whereas the case in which either eq. (1) or eq. (3) is not satisfied is represented by mark x. Moreover, in the case when the high-pressure water was sprayed, the spray pressure was 30 $N/mm^2$. As for the samples prepared with "high-pressure water sprayed", the weather resistance test was carried out.

TABLE 3

| Sample No. | Heating: Oxygen Concentration (Volume %) | Heating: Water Vapor Concentration (Volume %) | Quenching Pressure of High-Pressure Water ($N/mm^2$) |
|---|---|---|---|
| A1 | 1.1 | 4 | 760 |
| A2 | 1.3 | 5 | 810 |
| A3 | 1.4 | 9 | 780 |
| A4 | 1.8 | 10 | 800 |
| A5 | 2.9 | 8 | 820 |
| B1 | 1.0 | 5 | 650 |
| B2 | 1.2 | 7 | 680 |
| B3 | 1.4 | 9 | 710 |
| B4 | 1.8 | 11 | 700 |
| B5 | 2.3 | 16 | 690 |
| B6 | 2.6 | 17 | 660 |
| C1 | 1.2 | 5 | 560 |
| C2 | 1.3 | 8 | 570 |
| C3 | 1.7 | 11 | 610 |
| C4 | 2.6 | 12 | 570 |
| C5 | 2.7 | 14 | 580 |
| C6 | 3.1 | 18 | 600 |
| D1 | 1.4 | 5 | 510 |
| D2 | 1.2 | 9 | 530 |
| D3 | 1.4 | 11 | 420 |
| D4 | 1.6 | 12 | 400 |
| D5 | 2.1 | 13 | 480 |
| D6 | 2.5 | 14 | 425 |
| D7 | 2.6 | 16 | 410 |
| D8 | 2.7 | 10 | 510 |

Figure 6:
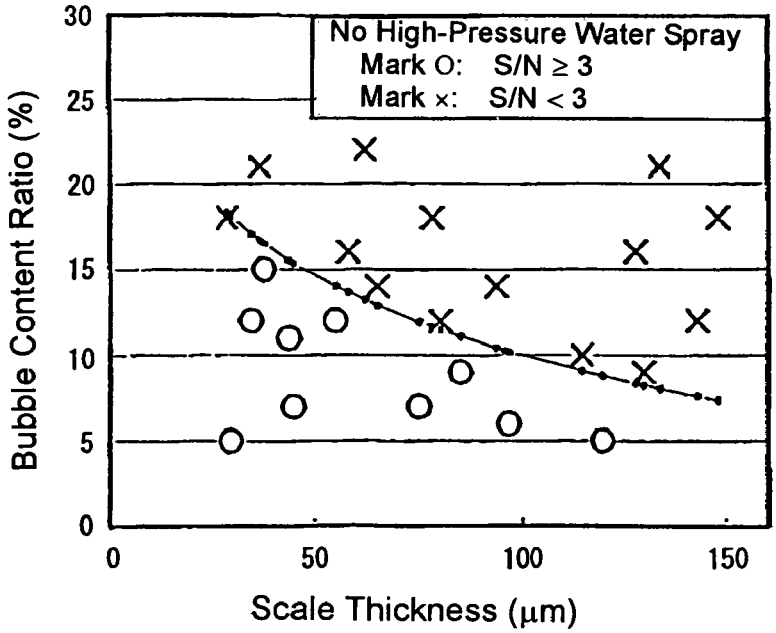
FIG. 6 is a view showing the relationship between the scale thickness and bubble content ratio for varied S/N ratios "without high-pressure water spray" in the experimental results.

FIG. 6 shows the evaluation results of "S/N ratio" in the relationship between the parameters "scale thickness" and "bubble content ratio", when "high-pressure water spray is not applied". The curve representing a boundary between the two areas indicated marks O and x can be expressed by the equation (1) itself. It can be recognized that the S/N ratio is satisfactory, when "bubble content ratio" situates below the curve, that is, when the equation (1) is satisfied.

As for the samples prepared with "high-pressure water sprayed", the S/N ratio is 3 or more, and therefore satisfactory, when the equation (3) is satisfied.

Figure 7:
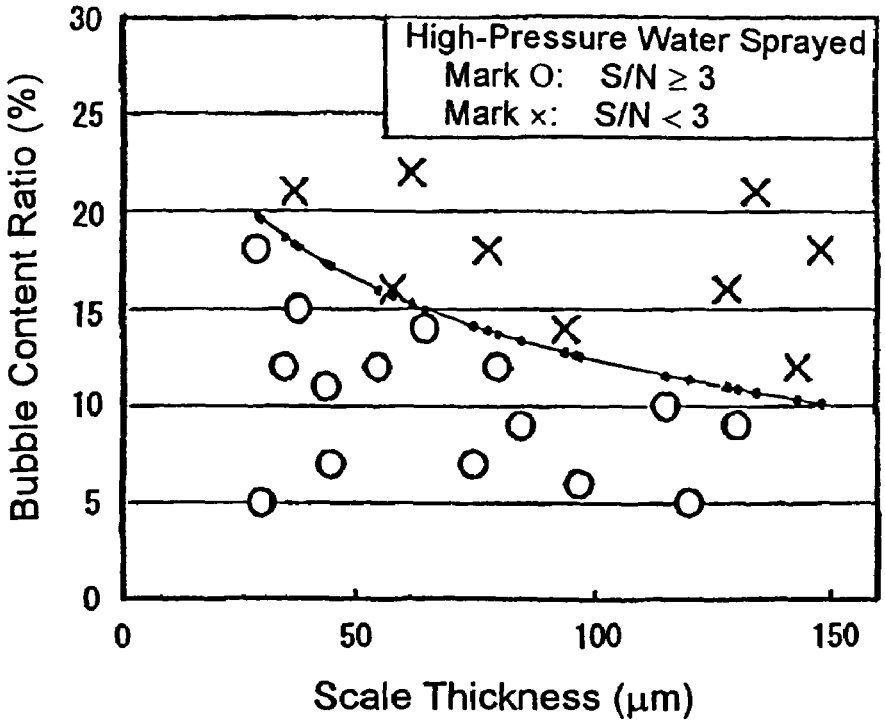
FIG. 7 is a view showing the relationship between the scale thickness, bubble content ratio and S/N ratios "with high-pressure water spray" in the experimental results.

FIG. 7 shows the evaluation results of "S/N ratio" in the case of "high-pressure water sprayed" similarly to the above. The curve in the diagram can be expressed by the equation (3) itself. It is found that the S/N ratio is good when the curve situates below "bubble content ratio". From the positions of curves in FIGS. 6 and 7, it can be seen that the limit value of the bubble content ratio becomes somewhat greater in the case of "high-pressure water sprayed".

From the results of the weather resistance test, a satisfactory trend can be seen, in the case when the bubble content ratio is particularly small.

Figure 8:
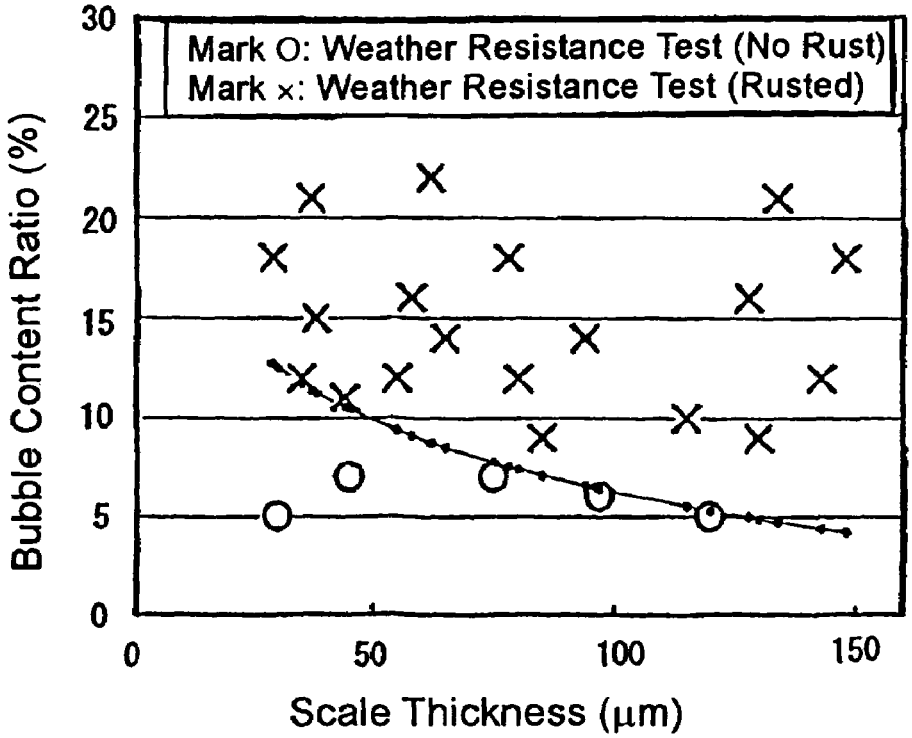
FIG. 8 is a view showing the relationship between the scale thickness, bubble content ratio and weather resistance in "with high-pressure water spray" in the experimental results.
Figure 9A:
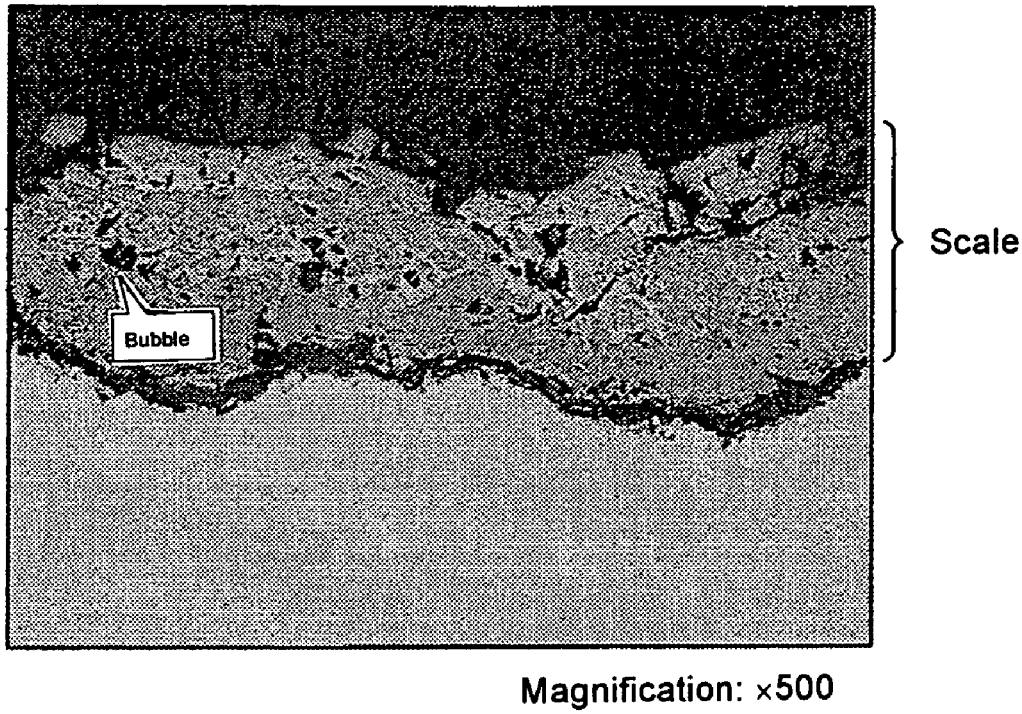
FIG. 9A is a sectional micrograph of a scale on the surface of a martensitic stainless steel produced by the manufacturing method in the prior art.
Figure 9B:
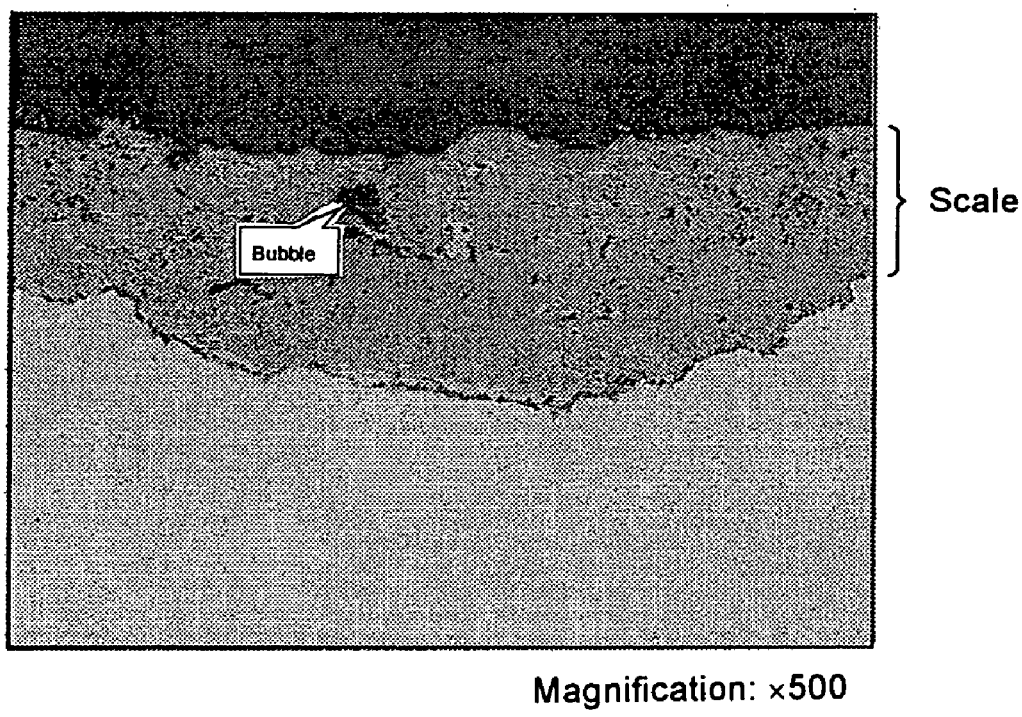
FIG. 9B is a sectional micrograph of a scale on the surface of a martensitic stainless steel produced by the manufacturing method according to the present invention.

FIG. 8 illustrates the results of "weather resistance test" in either mark O or x. The boundary between the respective areas indicated by the marks O and x is expressed by a curved line. A trend similar to the evaluation results of "S/N ratio" can be found.

In Table 6, the results of S/N ratio obtained in the ultrasonic test are listed for two types samples: The first type samples were prepared by the tempering process at 705° C. after quenching, and brush descaling of samples surface at 620° C. by virtue of remaining heat from the tempering (without the high-pressure water spray); and the second type samples were prepared by further spraying the high-pressure water having a pressure of 30 $N/mm^2$ onto the first type samples. In Table 5,

TABLE 4

| Sample No. | Scale Thickness (μm) | Bubble Content Ratio (%) | S/N ratio (No High-Pressure Water Spary) | | Bubble Content Ratio (%) Calculated Value of Right Hand Side of Eq. (1) | Conformance to Eq. (1) | S/N Ratio (High-Pressure Water Spray) | | Bubble Content Ratio (%) Calculated Value of Right Hand Side of Eq. (3) | Conformance to Eq. (3) | Weather Resitance Test |
|---|---|---|---|---|---|---|---|---|---|---|---|
| A1 | 30 | 5 | 5.9 | ○ | 18.08 | ○ | 6.2 | ○ | 19.53 | ○ | ○ |
| A2 | 35 | 12 | 4.8 | ○ | 17.04 | ○ | 5.1 | ○ | 18.62 | ○ | x |
| A3 | 38 | 15 | 3.6 | ○ | 16.49 | ○ | 3.9 | ○ | 18.14 | ○ | x |
| A4 | 29 | 19 | 2.9 | x | 18.30 | x | 3.2 | ○ | 19.73 | ○ | x |
| A5 | 37 | 21 | 2.7 | x | 16.67 | x | 2.6 | x | 18.30 | x | x |
| B1 | 45 | 7 | 4.9 | ○ | 15.36 | ○ | 5.3 | ○ | 17.14 | ○ | ○ |
| B2 | 44 | 11 | 5.2 | ○ | 15.51 | ○ | 4.7 | ○ | 17.27 | ○ | x |
| B3 | 55 | 12 | 3.9 | ○ | 14.02 | ○ | 4.1 | ○ | 16.00 | ○ | x |
| B4 | 65 | 14 | 2.9 | x | 12.90 | x | 3.5 | ○ | 14.97 | ○ | x |
| B5 | 58 | 16 | 2.6 | x | 13.67 | x | 2.9 | x | 15.64 | x | x |
| B6 | 62 | 22 | 2.5 | x | 13.22 | x | 2.7 | x | 15.25 | x | x |
| C1 | 75 | 7 | 5.0 | ○ | 11.95 | ○ | 5.4 | ○ | 14.13 | ○ | ○ |
| C2 | 85 | 9 | 4.2 | ○ | 11.11 | ○ | 4.2 | ○ | 13.39 | ○ | x |
| C3 | 80 | 12 | 2.8 | x | 11.51 | x | 3.7 | ○ | 13.75 | ○ | x |
| C4 | 94 | 14 | 2.9 | x | 10.44 | x | 2.7 | x | 12.79 | x | x |
| C5 | 78 | 18 | 2.8 | x | 11.68 | x | 2.7 | x | 13.90 | x | x |
| C6 | 96 | 25 | 2.6 | x | 10.29 | x | 2.5 | x | 12.67 | x | x |
| D1 | 97 | 6 | 4.8 | ○ | 10.23 | ○ | 5.3 | ○ | 12.61 | ○ | ○ |
| D2 | 120 | 5 | 3.9 | ○ | 8.80 | ○ | 4.1 | ○ | 11.35 | ○ | x |
| D3 | 115 | 10 | 2.2 | x | 9.09 | x | 3.5 | ○ | 11.60 | ○ | x |
| D4 | 130 | 9 | 2.3 | x | 8.27 | x | 3.2 | ○ | 10.88 | ○ | x |
| D5 | 143 | 12 | 2.4 | x | 7.63 | x | 2.9 | x | 10.32 | x | x |
| D6 | 128 | 16 | 2.3 | x | 8.37 | x | 2.7 | x | 10.97 | x | x |
| D7 | 148 | 18 | 2.1 | x | 7.40 | x | 2.8 | x | 10.12 | x | x |
| D8 | 134 | 21 | 2.2 | x | 8.06 | x | 2.5 | x | 10.70 | x | x |

From the results in Table 4, it can be recognized that the samples obtained with "high-pressure water unsprayed" exhibit a relation of S/N≧3, except for sample A4, when the equation (1) is satisfied (mark O) and therefore the samples are good.

an oxygen concentration as well as a water vapor concentration during heating in quench furnace, and a pressure of high-pressure water for quenching are listed.

TABLE 5

| Sample No. | Heating: Oxygen Concentration (Volume %) | Heating: Water Vapor Concentration (Volume %) | Quenching Pressure of High-Pressure Water ($N/mm^2$) |
|---|---|---|---|
| E1 | 1.2 | 4 | 780 |
| E2 | 1.4 | 7 | 820 |
| E3 | 1.7 | 8 | 760 |
| E4 | 2.2 | 11 | 790 |
| E5 | 2.6 | 8 | 800 |
| F1 | 1.1 | 6 | 620 |
| F2 | 1.5 | 9 | 680 |
| F3 | 1.6 | 10 | 640 |
| F4 | 2.1 | 13 | 700 |
| F5 | 2.8 | 16 | 630 |
| G1 | 1.3 | 6 | 580 |
| G2 | 1.6 | 9 | 520 |
| G3 | 2.1 | 12 | 550 |
| G4 | 2.6 | 10 | 560 |
| G5 | 2.7 | 13 | 570 |
| H1 | 1.3 | 5 | 520 |
| H2 | 1.5 | 6 | 450 |
| H3 | 2.0 | 12 | 460 |
| H4 | 2.6 | 13 | 430 |
| H5 | 2.9 | 17 | 510 |

TABLE 6

| Sample No. | Scale Thickness (μm) | Bubble Content Ratio (%) | S/N Ratio after Brush Treatment (No High-Pressure Water Spray) | | S/N Ratio after Brush Treatment (High-Pressure Water Sprayed) | |
|---|---|---|---|---|---|---|
| E1 | 29 | 4 | 6.0 | ○ | 6.0 | ○ |
| E2 | 33 | 13 | 5.4 | ○ | 5.4 | ○ |
| E3 | 37 | 15 | 4.2 | ○ | 4.2 | ○ |
| E4 | 31 | 18 | 3.7 | ○ | 3.7 | ○ |
| E5 | 37 | 20 | 2.9 | x | 2.9 | x |
| F1 | 43 | 8 | 5.3 | ○ | 5.3 | ○ |
| F2 | 43 | 12 | 4.6 | ○ | 4.6 | ○ |
| F3 | 52 | 13 | 4.5 | ○ | 4.5 | ○ |
| F4 | 64 | 14 | 3.6 | ○ | 3.2 | ○ |
| F5 | 61 | 17 | 2.7 | x | 2.7 | x |
| G1 | 72 | 8 | 5.5 | ○ | 5.5 | ○ |
| G2 | 79 | 10 | 4.5 | ○ | 4.5 | ○ |
| G3 | 84 | 12 | 3.8 | ○ | 3.8 | ○ |
| G4 | 93 | 15 | 2.8 | x | 2.7 | x |
| G5 | 81 | 18 | 2.7 | x | 2.7 | x |
| H1 | 94 | 7 | 4.7 | ○ | 4.7 | ○ |
| H2 | 139 | 9 | 3.2 | ○ | 4.2 | ○ |
| H3 | 124 | 12 | 2.4 | x | 3.2 | ○ |
| H4 | 148 | 17 | 2.6 | x | 2.9 | x |
| H5 | 139 | 20 | 2.6 | x | 2.6 | x |

In this case, no marked effect of the high-pressure water can be found for the samples having a scale thickness of less than 100 μm. However, a significant effect can be found for the samples having a scale thickness of 100 μm or more.

INDUSTRIAL APPLICABILITY

In the martensitic stainless steel tube according to the present invention, the content is determined by each of elements C, Si, Mn and Cr, and the bubble content ratio is further described in accordance with the scale thickness on the outer surface of the steel tube, so that defects can be detected with high precision in the non-destructive inspection, such as ultrasonic test or the like. This allows the non-destructive inspection to be carried out with high efficiency. Moreover, there is an advantage that the weather resistance can be enhanced. The steel tube according to the present invention and the manufacturing method thereof can be suitably used in all of the technical fields in which a martensitic stainless steel tube having comparative chemical components is treated.

The invention claimed is:

1. A martensitic stainless steel tube including C: 0.15-0.22%, Si: 0.1-1.0%, Mn: 0.30-1.00% and Cr: 12.00-16.00% in mass %, wherein a scale thickness on an outer surface of a steel tube is 150 μm or less, and wherein a bubble content ratio satisfies the following equation (1);

$$\text{bubble content ratio } (\%) \leqq -6.69 \times \ln(ds) + 40.83 \quad (1)$$

where ds: scale thickness (μm), and ln(x): natural logarithm of x.

2. A martensitic stainless steel tube according to claim 1, further including one group or more of Al: 0.1% or less, Ni: 1.0% or less and Cu: 0.25% or less in mass %.

3. A martensitic stainless steel tube including C: 0.15-0.22%, Si: 0.1-1.0%. Mn: 0.30-1.00% and Cr: 12.00-16.00% in mass %, wherein the scale thickness on the outer surface of the steel tube is 5-100 μm, and wherein the bubble content ratio satisfies the following equation (2):

$$\text{bubble content ratio } (\%) \leqq -5.20 \times \ln(ds) + 30.20 \quad (2)$$

where ds: scale thickness (μm), and ln(x): natural logarithm of x.

4. A martensitic stainless steel tube according to claim 3, further including one group or more of Al; 0.1% or less, Ni: 1.0% or less and Cu: 0.25% or less in mass %.

5. A method for manufacturing a martensitic stainless steel tube including C: 0.15-0.22%, Si: 0.1-1.0%, Mn: 0.30-1.00% and Cr: 12.00-16.00% in mass % or a martensitic stainless steel tube further including one group or more of Al: 0.1% or less, Ni: 1.0% or less and Cu: 0.25% or less in mass % in addition to said components, said method comprising the following steps of:

heating an in-process steel tube for duration between 5 min. or more and 30 min. or less at a temperature of "$A_{C3}$ point+20° C." or higher to 980° C. or lower in an atmosphere containing oxygen amount of 2.5 vol. % or less and water vapor amount of 15.0 vol. % or less;

quenching the steel tube thus heated at a cooling rate of 1-40° C./sec. from 980° C. to the A point, at a cooling rate of less than 1° C./sec. from the A point to the B point and at a cooling rate of 5-40° C./sec. from the B point to the ambient temperature, where the A point is 680-350° C. and the B point is 300-150° C.; and spraying a high-pressure water having a pressure of 490 $N/mm^2$ or higher onto the outer surface of the steel tube during at least a part of the cooling duration from 900° C. up to the A point of said quenching.

6. A method for manufacturing a martensitic stainless steel tube including C: 0.15-0.22%, Si: 0.1-1.0%, Mn: 0.30-1.00% and Cr: 12.00-16.00% in mass % or a martensitic stainless steel tube further including one group or more of Al: 0.1% or less, Ni: 1.0% or less and Cu: 0.25% or less in mass % in addition to said components, said method comprising the following steps of:

heating an in-process steel tube for duration between 5 min. or more and 30 min. or less at a temperature of "$A_{c3}$ point+20° C." or higher to 980° C. or lower in an atmosphere containing amount of oxygen 1.5 vol. % or less and amount of water vapor 3-10.0 vol. % or less;

quenching the steel tube thus heated at a cooling rate of 1-40° C./sec. from 980° C. up to the A point, at a cooling rate of less than 1° C./sec. from the A point to the B point and at a cooling rate of 5-40° C./sec. from the B point to the ambient temperature, where the A point is 680-350° C. and the B point is 300-150° C.; and spraying a high-pressure water having a pressure of 490 $N/mm^2$ or higher onto the outer surface of the steel tube during at least part of cooling duration from 900° C. up to the A point of said quenching.

7. A method for manufacturing a martensitic stainless steel tube according to claim 5, wherein the tempering process is carried out at a temperature of 630° C. or higher after said quenching.

8. A method for manufacturing a martensitic stainless steel tube according to claim 7, wherein the descaling process by means of brush or shot is carried out at a temperature range of 700-250° C. in the cooling step of the tempering process.

9. A method for manufacturing a martensitic stainless steel tube, wherein a high-pressure water having a pressure of 30 $N/mm^2$ or higher is sprayed onto the outer surface of the steel tube, after tempering the martensitic stainless steel tube according to claim 1.

10. A method for manufacturing a martensitic stainless steel tube according to claim 6, wherein the tempering process is carried out at a temperature of 630° C. or higher after said quenching.

11. A method for manufacturing a martensitic stainless steel tube, wherein a high-pressure water having a pressure of 30 $N/mm^2$ or higher is sprayed onto the outer surface of the steel tube, after tempering the martensitic stainless steel tube according to claim 2.

12. A method for manufacturing a martensitic stainless steel tube, wherein a high-pressure water having a pressure of 30 $N/mm^2$ or higher is sprayed onto the outer surface of the steel tube, after tempering the martensitic stainless steel tube according to claim 3.

13. A method for manufacturing a martensitic stainless steel tube, wherein a high-pressure water having a pressure of 30 $N/mm^2$ or higher is sprayed onto the outer surface of the steel tube, after tempering the martensitic stainless steel tube according to claim 4.

* * * * *